US010576485B2

(12) United States Patent
Jeong et al.

(10) Patent No.: US 10,576,485 B2
(45) Date of Patent: Mar. 3, 2020

(54) EJECTOR HAVING A CURVED GUIDE TO IMPROVE FLOW EFFICIENCY AND COOLING APPARATUS HAVING THE SAME

(71) Applicants: Samsung Electronics Co., Ltd., Suwon-si (KR); Korea University Research and Business Foundation, Seoul (KR)

(72) Inventors: Hee Moon Jeong, Yongin-si (KR); Yong Taek Hong, Suwon-si (KR); Seok Uk Kim, Hwaseong-si (KR); Seong Ho Kil, Seongnam-si (KR); Bo Heum Kim, Suwon-si (KR); Yong Chan Kim, Seoul (KR); Jae Jun Lee, Seoul (KR); Yong Seok Jeon, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 946 days.

(21) Appl. No.: 14/981,017

(22) Filed: Dec. 28, 2015

(65) Prior Publication Data

US 2016/0187037 A1 Jun. 30, 2016

(30) Foreign Application Priority Data

Dec. 30, 2014 (KR) ..... 10-2014-0192808

(51) Int. Cl.
*F25B 41/00* (2006.01)
*B05B 7/24* (2006.01)

(52) U.S. Cl.
CPC ..... *B05B 7/24* (2013.01); *F25B 41/00* (2013.01); *F25B 2341/0012* (2013.01)

(58) Field of Classification Search
CPC ..... F04F 5/16; F04F 5/46; F04F 5/54; F25B 2341/0012; F25B 9/08
See application file for complete search history.

(56) References Cited

U.S. PATENT DOCUMENTS

2002/0022172 A1 2/2002 Sahoda et al.
2002/0079384 A1* 6/2002 Popov ..... F04F 5/46 239/433

(Continued)

FOREIGN PATENT DOCUMENTS

CN 101532513 9/2009
CN 102187164 9/2011

(Continued)

OTHER PUBLICATIONS

European Search Report for 15202264 dated May 25, 2016.
Chinese Office Action dated May 5, 2019 in corresponding Chinese Patent Application No. 201511036226.8.

*Primary Examiner* — Filip Zec
(74) *Attorney, Agent, or Firm* — Staas & Halsey LLP

(57) ABSTRACT

As an ejector of the present disclosure and a cooling apparatus having the same include a suction guide unit at least partially having a curved surface so that the ejector guides a flow of a refrigerant, a structure is improved and thus a flow loss can be reduced. Also, through the improved structure, a mixture rate between a refrigerant passing through a nozzle unit and a refrigerant passing through a suction unit is improved, so that pressure rising efficiency can be increased to reduce a compressor load, and thus energy efficiency can be increased due to an increase in efficiency of the ejector.

24 Claims, 10 Drawing Sheets

(56) References Cited

U.S. PATENT DOCUMENTS

| | | | | |
|---|---|---|---|---|
| 2008/0060378 | A1 | 3/2008 | Gocho et al. | |
| 2009/0232665 | A1 | 9/2009 | Gocho et al. | |
| 2010/0126212 | A1* | 5/2010 | May | F25B 41/00 62/500 |
| 2013/0000348 | A1 | 1/2013 | Higashiiue et al. | |
| 2013/0239600 | A1 | 9/2013 | Verma et al. | |

FOREIGN PATENT DOCUMENTS

| | | | |
|---|---|---|---|
| CN | 102822535 | | 12/2012 |
| CN | 104081064 | | 10/2014 |
| CN | 104379941 | | 2/2015 |
| DE | 112013000817 | T5 | 12/2014 |
| EP | 1160522 | A1 | 12/2001 |
| JP | 2004116807 | A | 4/2004 |
| JP | 2010281567 | | 12/2010 |
| WO | 2013185164 | A1 | 12/2013 |

* cited by examiner

EJECTOR HAVING A CURVED GUIDE TO IMPROVE FLOW EFFICIENCY AND COOLING APPARATUS HAVING THE SAME

RELATED APPLICATION(S)

This application claims the benefit of Korean Patent Application No. 2014-0192808, filed on Dec. 30, 2014 in the Korean Intellectual Property Office, the disclosure of which is incorporated herein by reference.

BACKGROUND

The present disclosure relates to an ejector and a cooling apparatus having the same, and more specifically, to an ejector having a structure improved to increase efficiency and a cooling apparatus having the same.

Generally, a cooling apparatus is configured of a compressor, a condenser, an evaporator, and an expansion device. The compressor compresses a refrigerant at a high temperature and high pressure, and the condenser condenses the refrigerant discharged from the compressor and converts the refrigerant into a liquid refrigerant. The expansion device reduces the temperature and pressure of the refrigerant, discharged from the condenser, to a state that the evaporator requires through a throttling process. While the refrigerant is evaporated by absorbing heat from the surrounding air when passing through the evaporator, the refrigerant becomes a saturated air state at an outlet of the evaporator, and then when the refrigerant is introduced into the compressor again, a cycle is formed.

In this process, energy efficiency of the cooling apparatus is obtained by dividing a cooling load of the evaporator by a compressor load of the compressor. That is, to increase energy efficiency, the cooling load of the evaporator should be increased, or the compression load of the compressor should be decreased.

An ejector is provided to reduce the compression load of the compressor and to increase a pressure of gaseous refrigerant introduced into the compressor. Specifically, the ejector is configured to increase pressures of the introduced two-phase refrigerants. However, in a process of mixing the two-phase refrigerants moving in the ejector, when a flow loss is generated, there is a problem in which pressure rising efficiency is reduced.

SUMMARY

It is an aspect of the present disclosure to provide an ejector capable of increasing flow efficiency of fluid passing through the ejector and a cooling apparatus having the same.

In accordance with one aspect of the present disclosure, an ejector includes a nozzle unit in which a first refrigerant moves, a suction unit which is formed to surround the nozzle unit and forms a suction path in which a second refrigerant moves between the nozzle unit and the suction unit, a mixing unit being in communication with the suction unit and configured to form a mixed fluid of the first refrigerant and the second refrigerant, and a diffuser unit which extends from the mixing unit in a direction of an ejector center axis passing through centers of the nozzle unit, the suction unit, and the mixing unit and is configured to convert kinetic energy of the mixed fluid discharged from the mixing unit into pressure energy, wherein the suction unit may include a suction port into which the second refrigerant is introduced into the suction unit, and a suction guide unit which has at least one guide curved surface having a curved inner surface and has a cross-sectional area of the suction path reduced in a flow direction of the first refrigerant.

The guide curved surface may be formed of a curved line in which cross-sections in the direction of the ejector center axis are symmetrical to each other.

The guide curved surface may include a concave guide curved surface configured to guide a flow of the second refrigerant so that the second refrigerant moves toward the ejector center axis, and a convex guide curved surface arranged at a more downstream side than the concave guide curved surface and provided to have a cross-sectional area of the suction path more gently reduced than that of the concave guide curved surface.

When a radius curvature of the concave guide curved surface, $R_c$, and a radius curvature of the convex guide curved surface, $R_v$, $R_c<R_v$ may be satisfied.

The convex guide curved surface may extend from the concave guide curved surface.

Slopes of tangents at which the concave guide curved surface and the convex guide curved surface meet may be identical to each other.

The guide curved surface may include a convex guide curved surface configured to guide a movement direction of the second refrigerant passing through the suction guide unit to a movement direction of the first refrigerant, wherein a radius curvature of the convex guide curved surface, $R_v$, and a diameter of the mixing unit, $d_m$, may satisfy a relation of $0.4 \le R_v/d_m \le 2.7$.

The nozzle unit may include a nozzle body configured to form an appearance, and a nozzle guide unit configured to form a nozzle path in the nozzle body, wherein the nozzle guide unit may include a nozzle introducing unit configured to guide so that the first refrigerant is introduced to an inside of the nozzle body, a nozzle converging unit which is formed so that a diameter of the nozzle path is reduced in a movement direction of the first refrigerant to a nozzle neck having a smaller diameter than that of the nozzle introducing unit, and a nozzle dispersing unit formed so that a diameter of the nozzle path is increased in the movement direction of the first refrigerant from the nozzle neck and configured to guide a discharging of the first refrigerant to the inside of the ejector, wherein the nozzle converging unit may have a variation in diameter greater than that of the nozzle dispersing unit with respect to the movement direction of the first refrigerant.

A dispersing angle of the nozzle dispersing unit, $\alpha$, may satisfy a relation of $0.5° \le \alpha \le 2°$.

The nozzle dispersing unit may have an outlet having a smaller diameter than that of an inlet of the nozzle converging unit.

A length of the nozzle dispersing unit, $L_{nd}$, and a diameter of the nozzle neck with respect to the movement direction of the first refrigerant, $d_{th}$, may satisfy a relation of $10 \le L_{nd}/d_{th} \le 50$.

The nozzle body may include a nozzle tip configured to form an outlet of the nozzle dispersing unit, and an outer diameter of the nozzle tip, $d_{tip}$, and an inner diameter of the mixing unit, $d_m$, may form a relation of $d_{tip}/d_m<1$.

The outer diameter of the nozzle tip, $d_{tip}$, and an inner diameter of the nozzle tip, $d_{do}$, may form a relation of $1<d_{tip}/d_{do}<1.8$.

A slope between the ejector center axis and an outer surface of the nozzle body forming the nozzle tip, $\beta$, may be less than or equal to a slope between the ejector center axis and an inner surface of the suction guide unit, $\psi$.

The slope ($\beta$) may satisfy $5° \le \beta \le 30°$.

The slope ($\psi$) may satisfy $20° \le \psi \le 60°$.

The diffuser unit may include a diffuser body extending from the mixing unit, and a diffuser guide unit provided on an inner surface of the diffuser body to form a diffuser path through which the mixed fluid formed by the mixing unit is discharged and formed that a cross-sectional area of the diffuser path is increased in a flow direction of the mixed fluid, wherein the diffuser guide unit may include a diffuser curved surface having a curved inner surface.

The diffuser curved surface may be formed of a curved line in which cross-sections with respect to the ejector center axis are symmetrical to each other.

The diffuser curved surface may include a convex diffuser curved surface formed that a cross-sectional area of the diffuser path is increased and formed to be convex from the diffuser body toward the ejector center axis, and a concave diffuser curved surface arranged at a more downstream side than the convex diffuser curved surface and formed to be concave from the diffuser body from the ejector center axis.

The diffuser guide unit may further include a curved surface connection unit which has a slope identical to slopes of tangents of an upstream side of the concave diffuser curved surface and a downstream side of the convex diffuser curved surface and connects the convex diffuser curved surface with the concave diffuser curved surface.

With respect to the direction of the ejector center axis, an angle between a slope of a diameter of an outlet of the concave diffuser curved surface and a nozzle center axis may be greater than 0.

The diameter of the mixing unit, d_m, and the outer diameter of the nozzle tip, d_tip, may satisfy a relation of $1.2 \le d_m/d_tip \le 3$.

A diameter of the mixing unit, d_m, and a length of the mixing unit, L_m, may satisfy a relation of $4.5 \le L_m/d_m \le 28$.

A diameter of the mixing unit, d_m, and a length of the diffuser unit, L_d, may satisfy a relation of $7 \le L_d/d_m \le 31$.

A distance between an outlet of the nozzle unit and an inlet of the mixing unit, L_n, and a diameter of the mixing unit, d_m, may satisfy a relation of $0.2 \le L_n/d_m \le 2.5$.

In accordance with another aspect of the present disclosure, an ejector includes a nozzle unit in which a first refrigerant moves, a suction unit suctioning a second refrigerant by a flow of the first refrigerant discharged from the nozzle unit and formed to surround the nozzle unit, a mixing unit which is in communication with the suction unit and forms a mixed fluid of the first refrigerant and the second refrigerant, and a diffuser unit configured to convert kinetic energy of the mixed fluid of the first refrigerant and the second refrigerant, discharged from the mixing unit, into pressure energy, wherein the nozzle unit may include a nozzle body forming a nozzle path therein, and a nozzle tip provided at an end part of the nozzle body and forming an outlet of the nozzle path, wherein an outer diameter d_tip of the nozzle tip and an inner diameter d_m of the mixing unit may form a relation of $d_tip/d_m < 1$.

The outer diameter of the nozzle tip, d_tip, and an inner diameter of the nozzle tip, d_do, may form a relation of $1 < d_tip/d_do < 1.8$.

The nozzle unit may further include a nozzle guide unit forming a nozzle path in the nozzle body, wherein the nozzle guide unit may include a nozzle introducing unit configured to guide so that the first refrigerant is introduced into an inside of the nozzle body, a nozzle converging unit having a diameter of the nozzle path reduced in a movement direction of the first refrigerant to a nozzle neck having a smaller diameter than that of the nozzle introducing unit, and a nozzle dispersing unit formed so that the diameter of the nozzle path is increased in the movement direction of the first refrigerant from the nozzle neck to guide a discharging of the first refrigerant to the inside of the ejector, wherein a dispersing angle of the nozzle dispersing unit, a, may satisfy a relation of $0.5° \le \alpha \le 2°$.

A slope with an outer surface of the nozzle body forming the nozzle tip from an ejector center axis, β, may be less than or equal to a slope with an inner surface of a suction guide unit from the ejector center axis, ψ.

A length of the nozzle dispersing unit with respect to a movement direction of the first refrigerant, L_nd, and a diameter of a nozzle neck, d_th, may satisfy a relation of $10 \le L_nd/d_th \le 50$.

In accordance with still another aspect of the present disclosure, a cooling apparatus includes a first refrigerant circuit configured so that a refrigerant discharged from a compressor moves to a suction side of the compressor through a condenser, an ejector, and a vapor-liquid separator, and a second refrigerant circuit configured so that the refrigerant is suctioned into a suction port of the ejector and is circulated through the ejector, the vapor-liquid separator, a first expansion device, a first evaporator, and a second evaporator, wherein the ejector may include a nozzle unit in which a first refrigerant moves, a suction unit configured to suction a second refrigerant by a flow of the first refrigerant discharged from the nozzle unit and surround the nozzle unit, a mixing unit being in communication with the suction unit and forming a mixed fluid of the first refrigerant and the second refrigerant, and a diffuser unit configured to convert kinetic energy of the mixed fluid of the first refrigerant and the second refrigerant, discharged from the mixing unit, into pressure energy, wherein the suction unit may include a suction port through which the second refrigerant is introduced into an inside of the suction unit, and a tubular suction guide unit which forms a path in which the second refrigerant moves so that the second refrigerant introduced into the suction port moves along a flow of the first refrigerant and is formed so that a cross-sectional area of the path is reduced in a flow direction of the first refrigerant, wherein the tubular suction guide unit includes at least one guide curved surface having a cross-section curved in a fluid movement direction.

In accordance with yet another aspect of the present disclosure, an ejector includes a nozzle unit in which a first refrigerant moves, a suction unit configured to suction a second refrigerant by a flow of the first refrigerant discharged from the nozzle unit and surround the nozzle unit, a mixing unit being in communication with the suction unit and configured to form a mixed fluid of the first refrigerant and the second refrigerant, and a diffuser unit extending from the mixing unit with respect to an ejector center axis passing through centers of the nozzle unit, the suction unit, and the mixing unit and configured to convert kinetic energy of the mixed fluid, discharged from the mixing unit, into pressure energy, wherein the suction unit may include a suction port into which the second refrigerant is introduced into the suction unit, and a suction guide unit forming a suction path in which the second refrigerant moves so that the second refrigerant introduced into the suction port moves to the mixing unit along a flow of the first refrigerant, wherein the suction guide unit includes a first suction guide unit having a first angle between an inner surface of the first suction guide unit and a diffuser center axis, and a second suction guide unit which is connected with the first suction guide unit at a downstream side of the first suction guide unit and forms a second angle with the diffuser center axis to be smaller than the first angle.

The ejector of the present disclosure and the cooling apparatus having the same can increase fluid flow efficiency by improving a structure of a path of fluid and improve performance of the ejector.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, embodiments according to the present disclosure will be described in detail with reference to the accompanying drawings.

Figure 1:
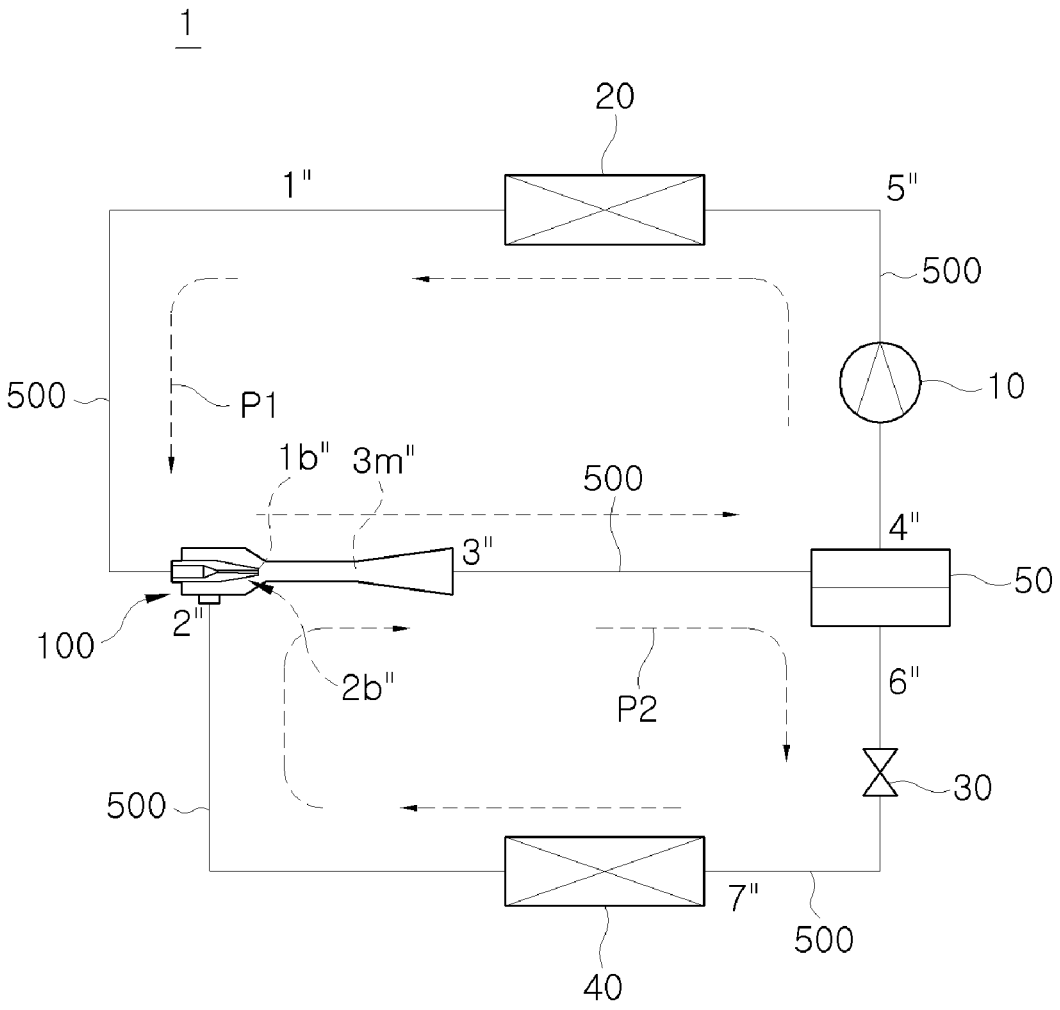
FIG. 1 is a view of a cooling apparatus according to a first embodiment of the present disclosure.
Figure 2:
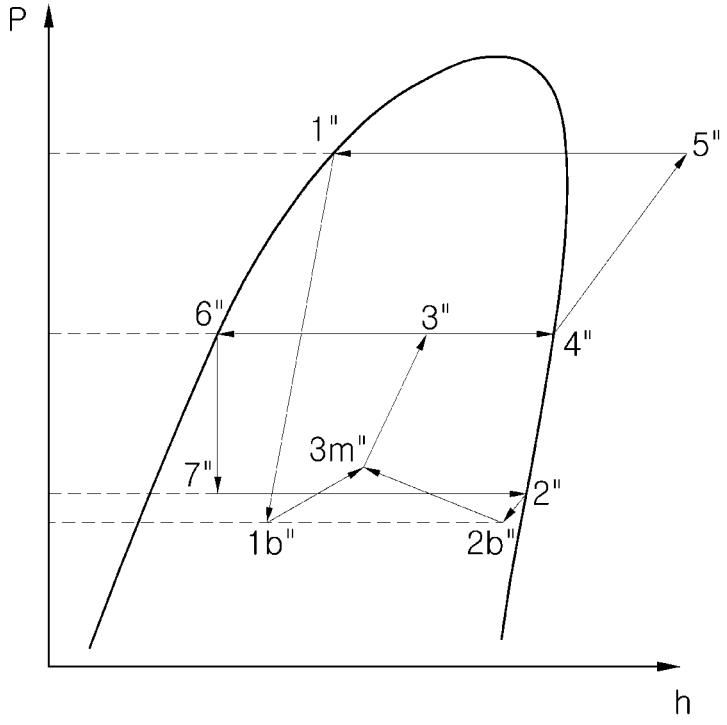
FIG. 2 is a P-h diagram of the cooling apparatus according to the first embodiment of the present disclosure.
Figure 3:
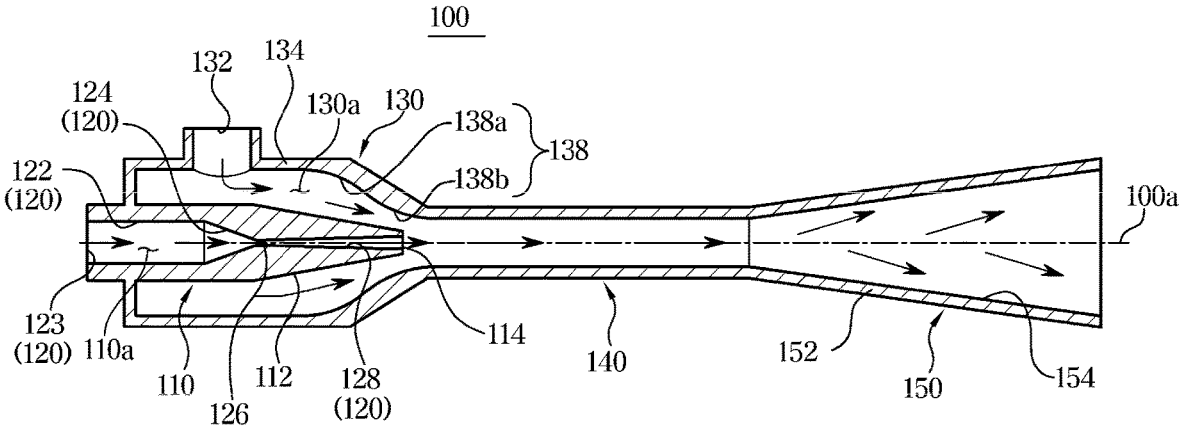
FIG. 3 is a cross-sectional view of an ejector according to the first embodiment of the present disclosure.

FIG. 1 is a view of a cooling apparatus 1 according to a first embodiment of the present disclosure, FIG. 2 is a P-h diagram of the cooling apparatus 1 of FIG. 1 according to the first embodiment of the present disclosure, and FIG. 3 is a cross-sectional view of an ejector 100 according to the first embodiment of the present disclosure.

The cooling apparatus 1 includes a compressor 10 that is connected to a condenser 20, an evaporator 40, and the ejector 100, through a refrigerant tube 500, forming a closed loop refrigerant circuit.

Specifically, the cooling apparatus 1 includes a first refrigerant circuit P1, and a second refrigerant circuit P2.

The first refrigerant circuit P1 is configured so that a refrigerant discharged from the compressor 10 is moved to a suction side of the compressor 10 through the condenser 20, the ejector 100, and a vapor-liquid separator 50. The second refrigerant circuit P2 is configured so that the refrigerant is suctioned to a suction unit 130 of the ejector 100 and circulated through the ejector 100, the vapor-liquid separator 50, an expansion device 30, and the evaporator 40.

A working refrigerant moving in the cooling apparatus 1 may include HC-based Isobutane R600a, propane R290, HFC-based R134a, and HFO-based R1234yf.

A coefficient of performance (COP) in the cooling apparatus 1 may be represented as a ratio of a cooling load of the evaporator 40 to a load of the compressor 10. In the embodiment of the present disclosure, a solution of increasing the COP by reducing a compression load expressed by the compressor 10, by using the ejector 100 having an improved structure will be described.

In the description of the present disclosure, a refrigerant (not shown) moving in the first refrigerant circuit P1 and a refrigerant (not shown) moving in the second refrigerant circuit P2 may be the same, but may have different phases. For the convenience of the description, the refrigerant moving in the first refrigerant circuit P1 is defined as a first refrigerant, and the refrigerant moving in the second refrigerant circuit P2 is defined as a second refrigerant.

The ejector 100 is provided to increase a pressure of a discharged refrigerant by mixing the phases of the first and second refrigerants and to reduce a compression load.

The ejector 100 may include a nozzle unit 110, the suction unit 130, a mixing unit 140, and a diffuser unit 150. The refrigerant discharged from the condenser 20 is referred as a first refrigerant, and the refrigerant discharged from the evaporator 40 is referred as a second refrigerant. The first refrigerant flows to the mixing unit 140 through the nozzle unit 110, and the second refrigerant is suctioned to the suction unit 130 and is mixed with the first refrigerant in the mixing unit 140, and then the mixed refrigerant is discharged from the ejector 100 through the diffuser unit 150. A detailed configuration of the ejector 100 will be described below in detail.

When the first refrigerant passes through the nozzle unit 110, ideally, the first refrigerant is isentropic-expanded, and an enthalpy difference before and after the nozzle unit 110 becomes a speed difference of the first refrigerant, and thus the first refrigerant may spurt from an outlet of the nozzle unit 110 at a high speed.

In the diffuser unit 150, speed energy of the mixed refrigerant of the first refrigerant and the second refrigerant is converted into pressure energy to have an effect of pressure rising, and a compression load is reduced when the refrigerant is suctioned into the compressor 10, and thus efficiency of a cycle is increased.

A refrigerant flow in the ejector 100 will be described.

The first refrigerant discharged from the condenser 20 is introduced into an inlet of the nozzle unit 110 of the ejector 100 (1"). While the first refrigerant passes through the nozzle unit 110 in the ejector 100, a flow velocity of the first refrigerant is increased and a pressure of the first refrigerant is decreased (1*b*").

The first refrigerant moves at the outlet of the nozzle unit 110 at a reduced pressure, and the second refrigerant (2") moving in a saturated air state via the evaporator 40 through the second refrigerant circuit P2 is suctioned into the suction unit 130 of the ejector 100 by a pressure difference between the second refrigerant (2") and the first refrigerant having a pressure relatively lower than a saturated pressure (2*b*").

The first refrigerant that has passed through the nozzle unit 110 and the second refrigerant that suctioned through the suction unit 130 are mixed in the mixing unit 140 of the ejector 100 (3"). When the mixed refrigerant passes through the diffuser unit 150, which may have a fan shape, and which is formed in an outlet unit of the ejector 100, a flow velocity of the mixed refrigerant is reduced and a pressure thereof is increased, and thus the mixed refrigerant is introduced into the vapor-liquid separator 50.

A gaseous refrigerant in the vapor-liquid separator 50 is introduced into the suction unit 130 of the compressor 10 (4"), and a liquid refrigerant (6") in a reduced temperature and pressure state is introduced into the evaporator 40 through the expansion device 30 (7"). While the refrigerant is evaporated by absorbing heat from the surrounding air while passing through the evaporator 40, the refrigerant at an outlet of the evaporator 40 becomes a saturated air state (2"). The refrigerant in the saturated air state is continuously circulated by being suctioned into the suction unit 130 of the ejector 100.

Thus, a pressure of the refrigerant suctioned into the compressor 10 in a cycle in which the ejector 100 is provided is more increased than in a cycle in which the ejector 100 is not provided. When the refrigerant introduced into the compressor 10 is compressed to a condensing temperature, a load amount of the compressor 10 is reduced. Since the mostly liquid refrigerant flows in the evaporator 40 provided on the second refrigerant circuit P2 through the vapor-liquid separator 50, cooling performance is increased, and thus the COP of the entire cycle is increased.

Figure 4:
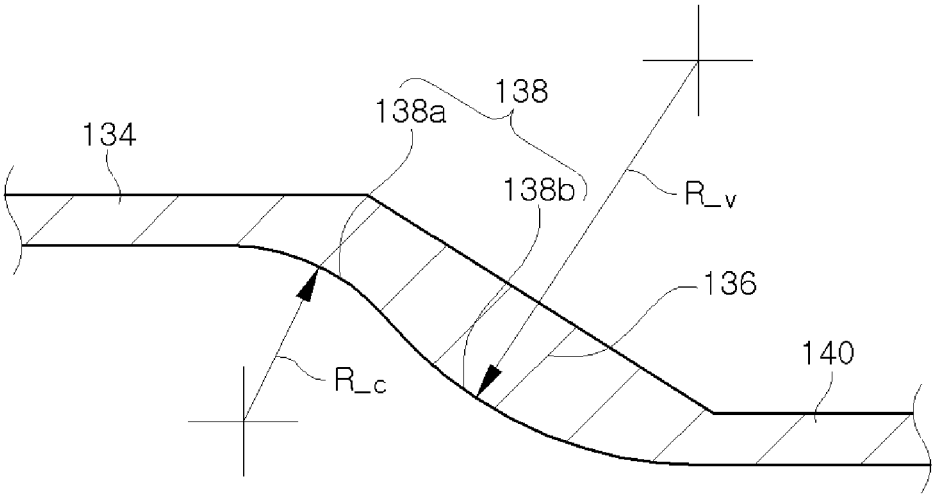
FIG. 4 is an enlarged view of a suction unit of the ejector according to the first embodiment of the present disclosure.
Figure 5:
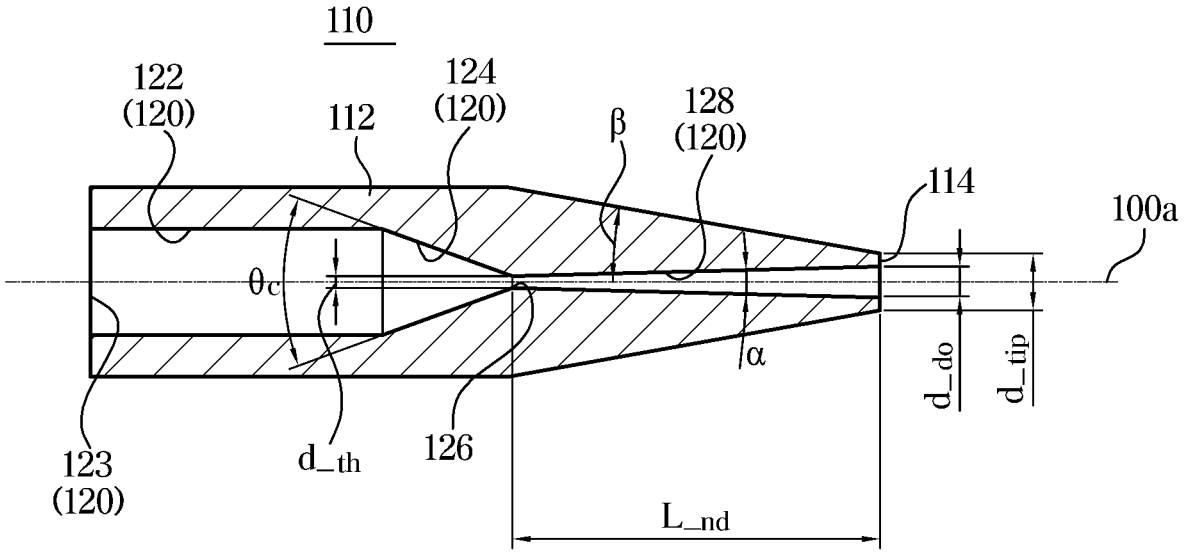
FIG. 5 is an enlarged view of a nozzle unit of the ejector according to the first embodiment of the present disclosure.
Figure 6A:
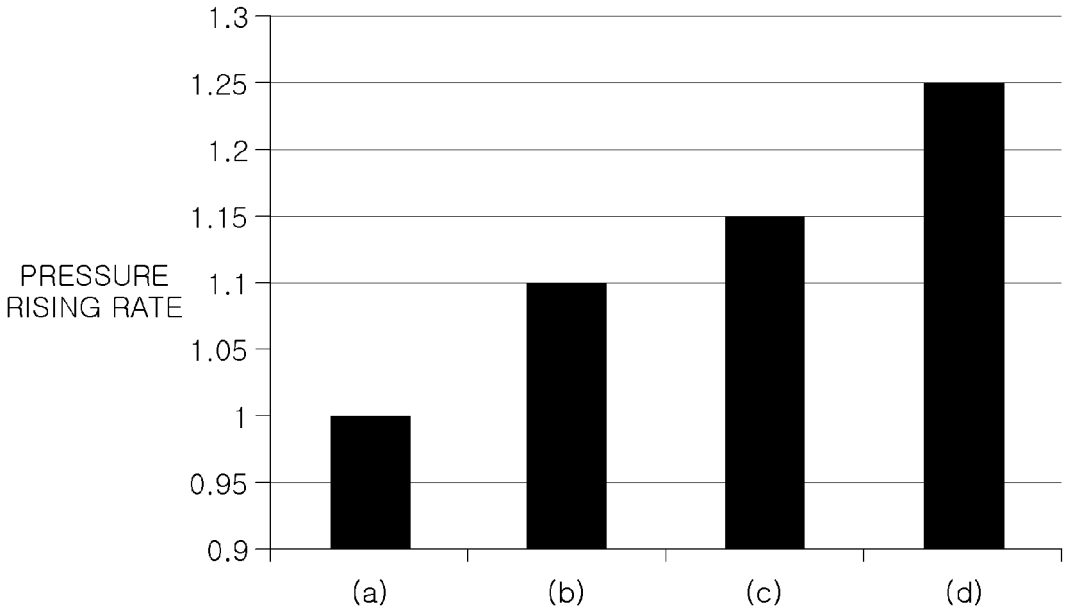
FIG. 6A is a graph of a pressure rising rate according to a shape of the nozzle unit of the ejector according to the first embodiment of the present disclosure.
Figure 6B:
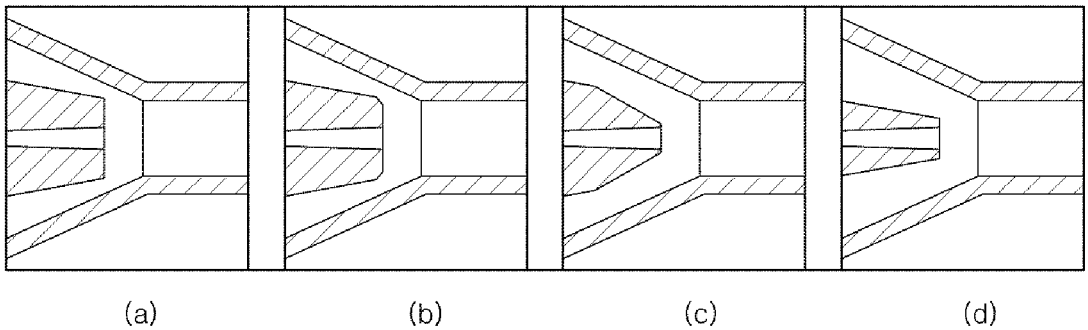
FIG. 6B illustrates nozzle units of FIG. 6A having variously shaped nozzle tips according to the first embodiment of the present disclosure.
Figure 7:
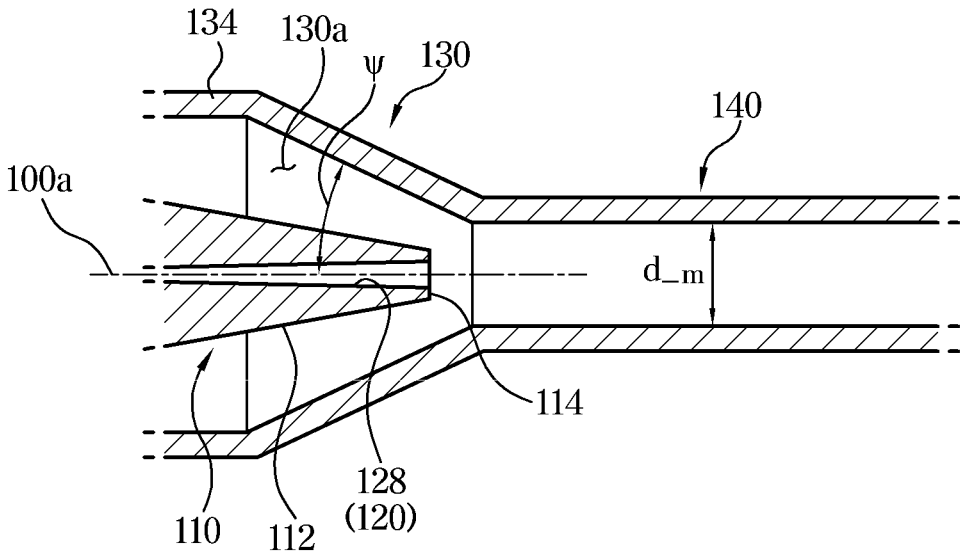
FIG. 7 is a partially enlarged view of the ejector according to the first embodiment of the present disclosure.

FIG. 4 is an enlarged view of a suction unit of the ejector according to the first embodiment of the present disclosure, FIG. 5 is an enlarged view of a nozzle unit of the ejector according to the first embodiment of the present disclosure, FIG. 6A is a graph of a pressure rising rate according to a shape of the nozzle unit of the ejector according to the first embodiment of the present disclosure, FIG. 6B illustrates nozzle units of FIG. 6A having variously shaped nozzle tips according to the first embodiment of the present disclosure, and FIG. 7 is a partially enlarged view of the ejector according to the first embodiment of the present disclosure.

The ejector 100 will be described.

The ejector 100 includes the nozzle unit 110, the suction unit 130, the mixing unit 140, and the diffuser unit 150. The nozzle unit 110, the suction unit 130, the mixing unit 140, and the diffuser unit 150 may have a shape of a body of revolution with respect to an ejector center axis 100*a*. The nozzle unit 110, the suction unit 130, the mixing unit 140, and the diffuser unit 150 may be formed in parallel to a direction of the ejector center axis 100*a*.

The suction unit 130 will be first described.

The suction unit 130 is provided so that a second refrigerant moving in the second refrigerant circuit P2 is introduced and moved. The second refrigerant is suctioned from the suction unit 130 and is mixed with the first refrigerant in the mixing unit 140. A suction path 130*a* in which the second refrigerant moves is formed between the nozzle unit 110 and the suction unit 130.

The second refrigerant is suctioned into the suction unit 130 by a flow of the first refrigerant discharged from the nozzle unit 110, and surrounds at least part of the nozzle unit 110. Specifically, the second refrigerant may move through the suction path 130*a* formed by an outer diameter of the nozzle unit 110 and an inner diameter of the suction unit 130. Specifically, the suction path 130*a* may be formed by the outer diameter of the nozzle unit 110 and inner diameters of a suction tube 134 and a suction guide unit 136 to be described below. For the configuration, the suction unit 130 is spaced apart from the nozzle unit 110 and surrounds a circumference of the nozzle unit 110.

The suction unit 130 has an approximately cylindrical shape and may be provided so that a diameter gets smaller in a movement direction of the second refrigerant.

The suction unit 130 may include a suction port 132 and the suction guide unit 136.

The suction port 132 is provided so that the second refrigerant is introduced into the suction unit 130. The suction port 132 is connected with an outlet unit of the evaporator 40, so that the second refrigerant discharged from the evaporator 40 is introduced into the suction unit 130 of the ejector 100 through the suction port 132. Specifically, as described above, since the first refrigerant moves at the outlet of the nozzle unit 110 at a reduced pressure and the second refrigerant is moved in a saturated air state, the second refrigerant is suctioned into the suction unit 130 of the ejector 100 by a pressure difference between the second refrigerant and the first refrigerant having a relatively lower pressure. The second refrigerant introduced into the suction unit 130 through the suction port 132 is moved to the suction guide unit 136 to be described below along an inner side of the suction tube 134. The suction tube 134 is provided to be in communication with the suction port 132, and is spaced apart from the circumference of the nozzle unit 110 and surrounds the nozzle unit 110. The suction tube 134 may be formed in an approximately cylinder shape.

The suction guide unit 136 is provided to form at least part of the suction path 130*a*. Specifically, the suction path 130*a* is formed by the outer diameter of the nozzle unit 110 and the inner diameter of the suction guide unit 136. The suction guide unit 136 is provided so that a cross-sectional area of the suction path 130*a* is reduced in a flow direction of the first refrigerant. The suction guide unit 136 may be provided in a tubular shape.

Since a path cross-sectional area of the mixing unit 140 is formed to be smaller than a cross-sectional area of the suction path 130*a*, the second refrigerant introduced into the suction unit 130 has a flow velocity increased while moving to the mixing unit 140. As the flow velocity of the first refrigerant discharged from the nozzle unit 110 and the flow velocity of the second refrigerant moving in the suction unit 130 correspond to each other, mixture efficiency of the first refrigerant and the second refrigerant in the mixing unit 140 is increased, and thus a structure of the suction unit 130 increasing the flow velocity of the second refrigerant becomes important.

The second refrigerant passing through the suction guide unit 136 is provided to move along a flow of the first refrigerant by a pressure difference between the first and second refrigerants. The suction guide unit 136 is formed so that a cross-sectional area of the suction path 130*a* is reduced in a flow direction of the first refrigerant. While the refrigerant is moved from the suction unit 130 to the mixing unit 140, as an angle in which the suction guide unit 136 forming the suction path 130*a* is folded is small and the suction guide unit 136 has a streamlined shape, a flow loss is reduced, thereby increasing pressure rise efficiency of the ejector 100.

The suction guide unit 136 may include a guide curved surface 138. The guide curved surface 138 is provided to form the suction path 130*a* and is provided so that a cross-sectional area of the suction path 130*a* is reduced in a movement direction of the first refrigerant. Also, the guide curved surface 138 is provided so that a flow loss of the second refrigerant moving in the suction guide unit 136 is reduced. A shape of the guide curved surface 138 is not limited, and at least a portion of the guide curved surface 138 may have a curved surface. Specifically, the suction guide unit 136 may include one of the guide curved surface 138 may be provided so that a cross-section in the direction of the ejector center axis 100*a* has a curved shape symmetrical with respect to the ejector center axis 100*a*.

The guide curved surface 138 may include a concave guide curved surface 138*a* and/or a convex guide curved surface 138*b*.

The concave guide curved surface 138*a* is provided to guide a flow of the second refrigerant so that the second refrigerant moves toward the ejector center axis 100*a*. The suction guide unit 136 is formed so that a cross-sectional area of the suction path 130*a* is reduced in a movement direction of the second refrigerant, and thus the concave guide curved surface 138*a* is formed so that a cross-sectional area of the suction path 130*a* is reduced from the suction tube 134 to the suction guide unit 136. According to the configuration, the second refrigerant has a flow toward the ejector center axis 100*a* along with a flow in the direction of the ejector center axis 100*a*.

As described above, the concave guide curved surface 138*a* is provided to guide a flow of the second refrigerant moving in the suction tube 134 by bending the flow of the second refrigerant to the suction guide unit 136. The concave guide curved surface 138*a* may have a curvature of R_c.

The concave guide curved surface 138*a* and the suction tube 134 may have the same slope at a contact point. Also, the concave guide curved surface 138*a* and the convex guide curved surface 138*b* to be described below may have the same slope at a contact point.

The convex guide curved surface 138*b* is arranged downstream from the concave guide curved surface 138*a*, and a cross-sectional area of the suction path 130*a* in the convex guide curved surface 138*b* is reduced more gently than in the concave guide curved surface 138*a*. The convex guide curved surface 138*b* guides a movement direction of the second refrigerant in a movement direction of the first refrigerant. The convex guide curved surface 138*b* may have a curvature of R_v. The convex guide curved surface 138*b* and the mixing unit 140 may have the same slope at a contact point. Preferably, the curvature R_v of the convex guide may be formed 0.4 to 2.7 times a diameter of the mixing unit 140.

That is, the curvature R_v of the convex guide curved surface 138*b* and a diameter d_m of the mixing unit 140 satisfy a relation of $0.4 \leq R_v/d_m \leq 2.7$.

According to the configuration, a flow loss may be minimized in a process in which both the first refrigerant introduced through the nozzle unit 110 and the second refrigerant introduced through the suction unit 130 move to the mixing unit 140.

The convex guide curved surface 138*b* may extend from the concave guide curved surface 138*a*. According to the configuration, the suction path 130*a* may be formed in a streamline shape and may reduce the flow loss. The tangential slopes at a point at which the concave guide curved surface 138*a* and the convex guide curved surface 138*b* meet may be same.

Unlike in the embodiment, a tubular surface is formed between the convex guide curved surface 138*b* and the concave guide curved surface 138*a*, and both configurations may be connected. In this case, both ends of the tubular surface may be connected with the convex guide curved surface 138*b* and the concave guide curved surface 138*a* at the same slope at a part at which the convex guide curved surface 138*b* and the concave guide curved surface 138*a* meet the both ends, respectively.

A radius curvature of the concave guide curved surface 138*a*, R_c, may be formed to be smaller than a radius curvature of the convex guide curved surface 138*b*, R_v. Thus, $R_c < R_v$. When the radius curvature of the concave guide curved surface 138*a*, R_c, is formed to be greater than the radius curvature of the convex guide curved surface 138*b*, R_v, a cross-sectional area of the suction unit 130 is sharply reduced, and thus a flow loss of the second refrigerant may be generated. Therefore, the radius curvature of the concave guide curved surface 138*a*, R_c, is formed to be smaller than the radius curvature of the convex guide curved surface 138*b*, R_v, so that a cross-sectional area of the suction path 130*a* connected to the mixing unit 140 is gradually reduced, and thus a flow velocity of the second refrigerant may be gradually increased.

Since the suction path 130*a* of the suction unit 130 is formed by an inner surface of the suction unit 130 and an outer surface of the nozzle unit 110, it is preferable that a cross-sectional area of the suction path 130*a* be gradually reduced in a movement direction of the second refrigerant.

The nozzle unit 110 may be provided so that the first refrigerant moves. Specifically, when the first refrigerant passes through the nozzle unit 110, the first refrigerant may be ideally isentropic-expanded. The first refrigerant introduced through the nozzle unit 110 may be mixed with the second refrigerant in the mixing unit 140. The nozzle unit 110 is provided so that a nozzle path 110*a* is formed therein.

The nozzle unit 110 may include a nozzle body 112 forming an appearance, and a nozzle guide unit 120 forming the nozzle path 110*a* in the nozzle body 112.

The nozzle guide unit 120 may include a nozzle introducing unit 122, a nozzle converging unit 124, a nozzle neck 126, and a nozzle dispersing unit 128.

The nozzle introducing unit 122 is provided to guide the first refrigerant to the nozzle converging unit 124 and the nozzle dispersing unit 128. A nozzle inlet 123 may be formed in the nozzle introducing unit 122. The nozzle inlet 123 is in communication with an outlet unit of the condenser 20, so the first refrigerant discharged from an outlet unit of the condenser 20 may be introduced.

The nozzle converging unit 124 is provided so that a diameter of a path is reduced in a movement direction of the first refrigerant to the nozzle neck 126 having a diameter smaller than that of the nozzle introducing unit 122. The nozzle converging unit 124 is connected to the nozzle introducing unit 122, and a diameter of the nozzle converging unit 124 is gradually reduced to be smaller than that of the nozzle introducing unit 122, and thus a flow velocity of the first refrigerant is increased.

The nozzle dispersing unit 128 is formed so that a diameter of the nozzle path 110*a* is increased in a movement direction of the first refrigerant from the nozzle neck 126. A pressure of the first refrigerant having a flow velocity increased when the first refrigerant passes through the nozzle converging unit 124 is reduced when the first refrigerant passes through the nozzle dispersing unit 128. The first refrigerant passing through the nozzle neck 126 may be discharged to the inside of the ejector 100 through the nozzle dispersing unit 128.

A slope in which a diameter of the nozzle converging unit 124 is reduced in a movement direction of the first refrigerant, that is a ratio of a maximum diameter of the nozzle converging unit 124 to a length of the nozzle converging unit 124 with respect to a nozzle center axis, becomes smaller than a ratio of the maximum diameter of the nozzle dispersing unit 128 to a length of the nozzle dispersing unit 128 with respect to the nozzle center axis. In other words, a variation in a diameter of the nozzle converging unit 124 for the same movement distance of the first refrigerant is greater than a variation in a diameter of the nozzle dispersing unit 128.

Specifically, an angle between opposite inner surfaces in the nozzle converging unit 124, $\Phi c$, is smaller than an angle between opposite inner surfaces in the nozzle dispersing unit 128, $\alpha$.

When a dispersing angle of the nozzle dispersing unit 128, $\alpha$, is excessively greater, a point in which delamination is generated gets gradually closer to the nozzle dispersing unit 128 in a movement of the first refrigerant passing through the nozzle dispersing unit 128, and thus there is a problem in which a flow velocity at an outlet of the nozzle dispersing unit 128 is reduced. Also, when a dispersing angle of the nozzle dispersing unit 128, α, is excessively smaller, a point in which delamination is generated in a flow of the first refrigerant passing through the nozzle dispersing unit 128 gets farther from the nozzle dispersing unit 128. However, since the first refrigerant is not easily moved, there is a problem in which a flow velocity is reduced. Therefore, it is preferable that the dispersing angle α of the nozzle dispersing unit 128 be formed at a slope of 0.5° to 2°. Also, it is preferable that a diameter of an outlet of the nozzle dispersing unit 128 be formed to be smaller than a diameter of an inlet of the nozzle converging unit 124.

The nozzle neck 126 is provided between the nozzle converging unit 124 and the nozzle dispersing unit 128 to communicate both configurations thereof. The nozzle neck 126 has the smallest diameter of the diameters of sections of the nozzle converging unit 124 and the nozzle dispersing unit 128, the first refrigerant passing through the nozzle converging unit 124 passes through the nozzle neck 126 to be introduced into the nozzle dispersing unit 128. A length of the nozzle dispersing unit 128, L_nd, and a diameter of the nozzle neck 126, d_th, may be formed to satisfy a relation of 10≤L_nd/d_th≤50 with respect to a movement direction of the first refrigerant.

The nozzle body 112 has an approximately cylindrical shape and may have a triangular pyramid shape so that the outer diameter becomes smaller toward the outlet of the nozzle dispersing unit 128.

The nozzle body 112 may include a nozzle tip 114 provided at an end part of the nozzle body 112, that is, an outlet side of the nozzle dispersing unit 128. That is, the outlet of the nozzle dispersing unit 128 is provided in the center of the nozzle tip 114.

When an outer diameter of the nozzle tip 114 is excessively greater, movement of a fluid flowing to the mixing unit 140 is interrupted, thereby reducing flow efficiency. Therefore, the nozzle tip 114 having an inner diameter in which the outlet of the nozzle dispersing unit 128 is maintained and an outer diameter in which movement of the fluid is not interrupted is needed.

Therefore, an outer diameter of the nozzle tip 114, d_tip, may be provided to form a relation of d_tip/d_m<1 with an inner diameter of the mixing unit 140, d_m. Preferably, d_tip may be provided to form a relation of 1.2≤d_m/d_tip≤3. Also, the outer diameter of the nozzle tip 114, d_tip, may be provided to form a relation of 1<d_tip/d_do<1.8 with a diameter of the outlet of the nozzle dispersing unit 128, d_do. According to the configuration, the first refrigerant discharged from the nozzle dispersing unit 128 can flow to the mixing unit 140 without an interruption due to the nozzle tip 114, and at the same time, a shape of a discharged part of the first refrigerant formed in the nozzle dispersing unit 128 can be prevented from being deformed.

Relation between a slope between an outer surface of the nozzle body 112 forming the nozzle tip 114 and the ejector center axis 100*a* and a slope between an inner surface of the suction guide unit 136 and the ejector center axis 100*a* also has an effect on flow efficiency of the ejector 100. When a slope between the ejector center axis 100*a* and the outer surface of the nozzle body 112 forming the nozzle tip 114 is referred as β, and a slope between the ejector center axis 100*a* and the inner surface of the suction guide unit 136 is referred as ψ, a relation of β≤ψ is formed. According to the relation, a suction path 130*a* having a cross-sectional area reduced by the suction guide unit 136 and the nozzle unit 110 may be formed.

Satisfying the relation, β may be preferably formed at 5° to 30°, and ψ may be preferably formed at 20° to 60°.

FIG. 6A is a graph illustrating a pressure rising in the nozzle unit 110, and FIG. 6B illustrates the nozzle unit 110 having variously shaped nozzle tips 114.

In FIG. 6A(a), the relation of β≤ψ is satisfied, but the nozzle tip 114 has a relation of d_tip/d_do>1.8. In (b), the nozzle tip 114 has a relation of d_tip/d_do>1.8, and an end part of the nozzle tip 114 is rounded. In (c), the nozzle tip 114 has a relation of d_tip/d_do>1.8, and an end part of the nozzle tip 114 is rounded to be larger than in (b). In (d), as described above, the nozzle tip 114 has a shape satisfying relations of 1<d_tip/d_do<1.8 and β≤ψ.

From (a) to (d), shapes of the nozzle dispersing units 128 are the same, but shapes of the nozzle body 112 and the nozzle tip 114 are different. FIG. 6*a* illustrates pressure rising efficiency of the first refrigerant according to a change in the shape. Therefore, like in the embodiment of the present disclosure, when the nozzle body 112 satisfies the relations of 1<d_tip/d_do<1.8 and β≤ψ, flow efficiency of the first refrigerant may be improved.

The diffuser unit 150 is provided to convert kinetic energy of a fluid to pressure energy. A flow velocity of the first refrigerant is increased when the first refrigerant passes through the nozzle unit 110, and the first refrigerant and the second refrigerant are mixed when passing through the mixing unit 140. Speed energy of a mixed fluid mixed in the mixing unit 140 is converted into pressure energy in the diffuser unit 150, and pressure rising occurs. Therefore, when the fluid is suctioned into the compressor 10, a compression load is reduced, and thus efficiency of cycle is increased.

The diffuser unit 150 may extend from the mixing unit 140 along the ejector center axis 100*a*. The diffuser unit 150 may include a diffuser body 152 that has a funnel shape and a diffuser guide unit 154.

The diffuser guide is provided inside the diffuser body 152 to form a diffuser path in which the mixed fluid formed by the mixing unit 140 moves. The diffuser path formed by the diffuser guide has a cross-sectional area increased in a movement direction of the fluid.

The mixing unit 140 is provided to mix the first refrigerant with the second refrigerant. The pressure rising rate in the ejector 100 is important to reduce a compression load of the compressor 10 through the ejector 100, and the pressure rising rate varies depending on a difference of a mixture degree of the first refrigerant and the second refrigerant in the mixing unit 140.

The outer diameter of the nozzle tip 114, d_tip, and the diameter of the mixing unit 140, d_m, may satisfy a relation of 1.2≤d_m/d_tip≤3, and the diameter of the mixing unit 140, d_m, and the length of the mixing unit 140, L_m, may satisfy a relation of 4.5≤L_m/d_m≤28. The diameter of the mixing unit 140, d_m, and a length of the diffuser, L_d, may satisfy a relation of 7≤L_d/d_m≤31. Also, a distance between an outlet of the nozzle unit 110 and an inlet of the mixing unit 140, L_n, and the diameter of the mixing unit 140, d_m, satisfy a relation of 0.2≤L_n/d_m≤2.5.

According to the configuration, a flow loss can be minimized when the first refrigerant and the second refrigerant are mixed in the mixing unit 140.

Hereinafter, an ejector according to a second embodiment of the present disclosure and a cooling apparatus having the same will be described.

Configurations of the embodiment overlapped with those of the above-described embodiment will be omitted.

Figure 8:
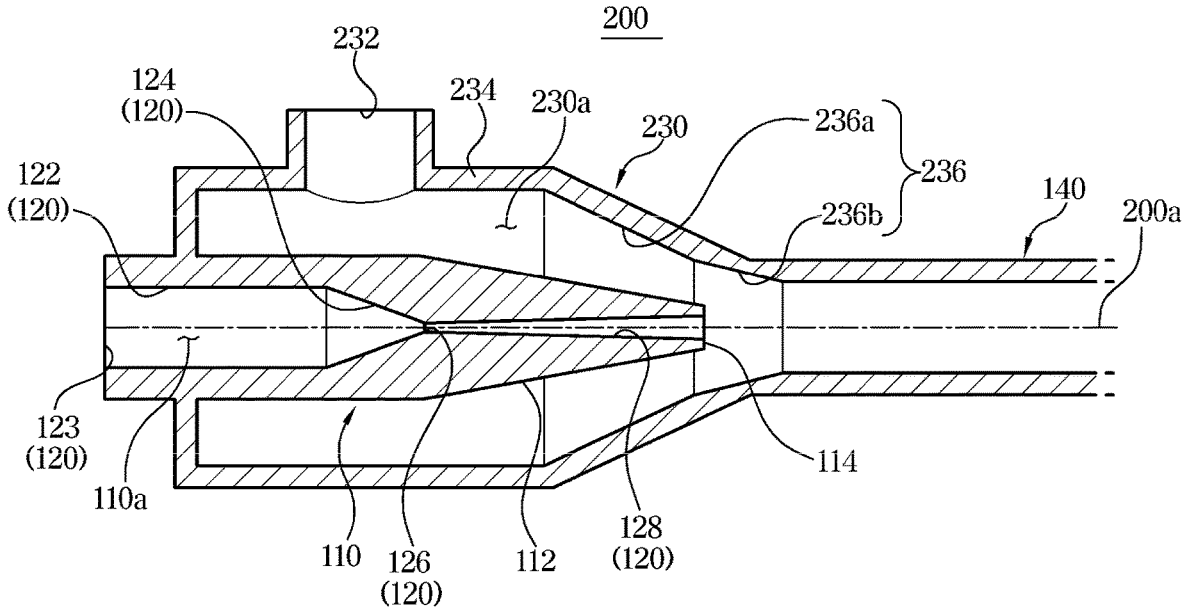
FIG. 8 is a cross-sectional view of an ejector according to a second embodiment of the present disclosure.

FIG. 8 is a cross-sectional view of an ejector according to a second embodiment of the present disclosure.

An ejector 200 includes the nozzle unit 110, a suction unit 230, the mixing unit 140, and the diffuser unit 150. The nozzle unit 110, the suction unit 230, the mixing unit 140, and the diffuser unit 150 may have a shape of a body of revolution with respect to an ejector center axis 200*a*. The nozzle unit 110, the suction unit 230, the mixing unit 140, and the diffuser unit 150 are formed in parallel to each other in a direction of the ejector center axis 200*a*.

The suction unit 230 is provided so that the second refrigerant flowing in the second refrigerant circuit P2 is introduced to move therein. The second refrigerant is suctioned from the suction unit 230 and is mixed with the first refrigerant in the mixing unit 140. The suction unit 230 includes a suction path 230*a*, formed between the nozzle unit 110 and the suction unit 230, in which the second refrigerant moves.

The second refrigerant is suctioned to the suction unit 230 by a flow of the first refrigerant discharged from the nozzle unit 110, and surrounds at least part of the nozzle unit 110. Specifically, the second refrigerant may flow through the suction path 230*a* formed by an outer diameter of the nozzle unit 110 and an inner diameter of the suction unit 230. Specifically, the suction path 230*a* may be formed by the outer diameter of the nozzle unit 110 and inner diameters of a suction guide unit 236 and a suction tube 234 to be described below. According to the configuration, the suction unit 230 is spaced apart from the nozzle unit 110 and surrounds a circumference of the nozzle unit 110.

The suction unit 230 has an approximately cylinder shape and has a diameter reduced in a movement direction of the second refrigerant.

The suction unit 230 may include a suction port 232 and the suction guide unit 236.

The suction port 232 is provided so that the second refrigerant is introduced into the suction unit 230. The suction port 232 is connected with an outlet of the evaporator 40 and is provided so that the second refrigerant discharged from the evaporator 40 is introduced into the suction unit 230 of the ejector 200 through the suction port 232. Specifically, as described above, at the outlet of the nozzle unit 110, the first refrigerant moves at a reduced pressure and the second refrigerant moves in a saturated air state, and thus the second refrigerant is suctioned into the suction unit 230 of the ejector 200 by a pressure difference between the second refrigerant and the first refrigerant having a relatively lower pressure. The second refrigerant introduced into the suction unit 230 through the suction port 232 moves to the suction guide unit 236 to be described below along an inner side of the suction tube 234.

The suction tube 234 is in communication with the suction port 232, and is spaced apart from the circumference of the nozzle unit 110 and surrounds the nozzle unit 110. The suction tube 234 may have an approximately cylindrical shape.

The suction guide unit 236 is provided to form at least part of the suction path 230*a*. Specifically, the suction path 230*a* is formed by the outer diameter of the nozzle unit 110 and the inner diameter of the suction guide unit 236. The suction guide unit 236 is provided that a cross-sectional area of the suction path 230*a* is reduced in a flow direction of the first refrigerant. The suction guide unit 236 may have a tubular shape.

Since a cross-sectional area of a path in the mixing unit 140 is formed to be smaller than a cross-sectional area of the suction path 230*a*, a flow velocity is increased while the second refrigerant introduced into the suction unit 230 moves to the mixing unit 140. As a flow velocity of the first refrigerant discharged from the nozzle unit 110 and a flow velocity of the second refrigerant moving in the suction unit 230 correspond to each other, a mixture rate of the first refrigerant and the second refrigerant in the mixing unit 140 is increased, and thus a structure of the suction unit 230 capable of efficiently increasing the flow velocity of the second refrigerant becomes important.

The second refrigerant passing through the suction guide unit 236 is moved by a pressure difference between the first and second refrigerants along a flow of the first refrigerant. The suction guide unit 236 is formed so that a cross-sectional area of the suction path 230*a* is reduced in a flow direction of the first refrigerant.

The suction guide unit 236 may include a first suction guide unit 236*a* and a second suction guide unit 236*b*. An inner surface of the first suction guide unit 236*a* forms a first angle with the ejector center axis 200*a*. An inner surface of the second suction guide unit 236*b* forms a second angle with the ejector center axis 200*a*. The second angle is formed to be smaller than the first angle. In the embodiment of the present disclosure, for the convenience of the description, it is described that the suction guide unit 236 includes the first suction guide unit 236*a* and the second suction guide unit 236*b*, but the suction guide unit 236 may include a plurality of the suction guide units 236. That is, the suction guide unit 236 includes from the first suction guide unit 236*a* to the nth suction guide unit, and n is not limited.

According to the configuration, since a cross-sectional area of the suction path 230*a* is gradually reduced, a flow loss of the second refrigerant passing through the suction path 230*a* may be reduced. Also, as n is greater, the suction guide unit 236 has a shape similar to streamline, and thus a flow loss of the second refrigerant may be reduced.

An ejector according to a third embodiment of the present disclosure and a cooling apparatus having the same will be described.

Configurations of the embodiment overlapped with those of the above-described embodiment will be omitted.

Figure 9:
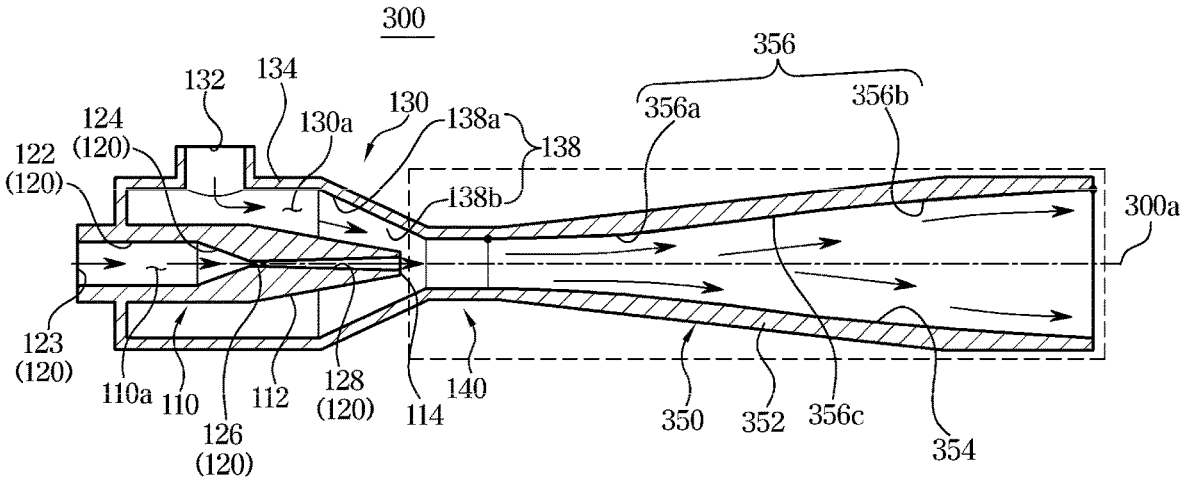
FIG. 9 is a cross-sectional view of an ejector according to a third embodiment of the present disclosure.

FIG. 9 is a cross-sectional view of an ejector according to a third embodiment of the present disclosure.

An ejector 300 includes the nozzle unit 110, the suction unit 130, the mixing unit 140, and a diffuser unit 350.

The diffuser unit 350 is provided to convert kinetic energy of a fluid to pressure energy. A flow velocity of the first refrigerant is increased when the first refrigerant passes through the nozzle unit 110, and the first refrigerant and the second refrigerant are mixed when the first refrigerant passes through the mixing unit 140. Speed energy of a mixed fluid mixed in the mixing unit 140 is converted into pressure energy in the diffuser unit 350, and pressure rising occurs. Thus, when a fluid is suctioned into the compressor 10, a compression load is reduced, and thus efficiency of a cycle is reduced.

The diffuser unit 350 may extend from the mixing unit 140 along an ejector center axis 300*a*. The diffuser unit 350 includes a diffuser body 352 that has a funnel shape and a diffuser guide unit 354.

The diffuser guide is provided on an inner surface of the diffuser body 352, and a diffuser path in which the mixed fluid formed by the mixing unit 140 moves is formed. The diffuser path formed by the diffuser guide is formed so that a cross-sectional area of a path is increased in a flow direction of the fluid.

The diffuser guide unit 354 may include a diffuser curved surface 356 having a curved inner surface.

The diffuser curved surface 356 is formed so that a cross-section is symmetric with respect to the ejector center axis 300*a*.

The diffuser curved surface 356 may include a convex diffuser curved surface 356*a* and a concave diffuser curved surface 356*b*.

The convex diffuser curved surface 356*a* is formed so that a cross-sectional area of the diffuser path is increased in a movement direction of the mixed fluid, and the convex diffuser curved surface 356*a* is formed to be convex toward the ejector center axis 300*a*. Since an upstream part of the convex diffuser curved surface 356*a* is connected with the mixing unit 140, a slope of a tangent at a part in which the convex diffuser curved surface 356*a* is connected with the mixing unit 140 may be identical to a slope of the mixing unit 140. Specifically, a slope formed with an inner surface of the mixing unit 140 with respect to the ejector center axis 300*a* may be identical to a slope at a part in which the convex diffuser curved surface 356*a* is connected with the mixing unit 140.

The concave diffuser curved surface 356*b* is arranged more downstream than the convex diffuser curved surface 356*a* and is formed to be concave from the ejector center axis 300*a*. Both the convex diffuser curved surface 356*a* and the concave diffuser curved surface 356*b* are provided to minimize a flow loss of fluid passing through the diffuser unit 350. A downstream part of the concave diffuser curved surface 356*b* forms an outlet unit of the diffuser unit 350.

A downstream part of the concave diffuser curved surface 356*b* is parallel to the ejector center axis 300*a* to eject the first refrigerant discharged from the diffuser unit 350, or a slope from the ejector center axis 300*a* in a movement direction of the mixed fluid may be more than or equal to 0.

The diffuser guide unit 354 may further include a curved surface connection unit 356*c* connecting the concave diffuser curved surface 356*b* with the convex diffuser curved surface 356*a*. A slope of the curved surface connection unit 356*c* may be identical to slopes of tangents at a downstream part of the convex diffuser curved surface 356*a* and an upstream part of the concave diffuser curved surface 356*b*.

A configuration of the convex diffuser curved surface 356*a*, the concave diffuser curved surface 356*b*, and the curved surface connection unit 356*c* may change lengths and radius curvatures thereof depending on a size or use of the ejector 300.

In the embodiment of the present disclosure, the curved surface connection unit 356*c* is arranged between the convex diffuser curved surface 356*a* and the concave diffuser curved surface 356*b*, but the curved surface connection unit 356*c* may be omitted. When the curved surface connection unit 356*c* is omitted, slopes of tangents at a part in which the convex diffuser curved surface 356*a* and the concave diffuser curved surface 356*b* meet are identical to each other.

While specific embodiments of the present disclosure have been illustrated and described above, the disclosure is not limited to the aforementioned specific embodiments. Those skilled in the art may variously modify the disclosure without departing from the gist of the disclosure claimed by the appended claims and the modifications are within the scope of the claims.

What is claimed is:

1. An ejector applied to a cooling apparatus, comprising:

a nozzle which a first refrigerant moves therethrough;

a suction which is formed to surround the nozzle and forms a suction path in which a second refrigerant moves between the nozzle and the suction;

a mixer being in communication with the suction and configured to form a mixture of the first refrigerant and the second refrigerant; and a diffuser which extends from the mixer in a direction of an ejector center axis passing through centers of the nozzle, the suction, and the mixer and is configured to convert kinetic energy of the mixed fluid discharged from the mixer into pressure energy, wherein the suction includes a suction port into which the second refrigerant is introduced into the suction, and a suction guide which has a guide curved surface having a curved inner surface and has a cross-sectional area of the suction path reduced in a flow direction of the first refrigerant, and the guide curved surface includes a concave guide curved surface configured to guide a flow of the second refrigerant so that the second refrigerant moves toward the ejector center axis, and a convex guide curved surface extends from the concave guide curved surface, arranged at a more downstream side than the concave guide curved surface and provided to have a cross-sectional area of the suction path more gently reduced than that of the concave guide curved surface.

2. The ejector according to claim 1, wherein the guide curved surface is formed of a curved line in which cross-sections in the direction of the ejector center axis are symmetrical to each other.

3. The ejector according to claim 1, wherein when a radius curvature of the concave guide curved surface, R_c, and a radius curvature of the convex guide curved surface, R_v, satisfy R_c<R_v.

4. The ejector according to claim 1, wherein slopes of tangents at which the concave guide curved surface and the convex guide curved surface meet are identical to each other.

5. The ejector according to claim 1, wherein the guide curved surface includes a convex guide curved surface configured to guide a movement direction of the second refrigerant passing through the suction guide to a movement direction of the first refrigerant, wherein a radius curvature of the convex guide curved surface, R_v, and a diameter of the mixer, d_m, satisfy a relation of $0.4 \leq R_v/d_m \leq 2.7$.

6. The ejector according to claim 1, wherein:

the nozzle includes a nozzle body configured to form an appearance, and a nozzle guide configured to form a nozzle path in the nozzle body;

the nozzle guide includes a nozzle introducer configured to guide so that the first refrigerant is introduced to an inside of the nozzle body, a nozzle convergence which is formed so that a diameter of the nozzle path is reduced in a movement direction of the first refrigerant to a nozzle neck having a smaller diameter than that of the nozzle introducer, and a nozzle disperser formed so that a diameter of the nozzle path is increased in the movement direction of the first refrigerant from the nozzle neck and configured to guide a discharging of the first refrigerant to the inside of the ejector; and the nozzle convergence has a variation in diameter greater than that of the nozzle disperser with respect to the movement direction of the first refrigerant.

7. The ejector according to claim 6, wherein a dispersing angle of the nozzle disperser, $\alpha$, satisfies a relation of $0.5° \leq \alpha \leq 2°$.

8. The ejector according to claim 6, wherein the nozzle disperser has an outlet having a smaller diameter than that of an inlet of the nozzle convergence.

9. The ejector according to claim 6, wherein a length of the nozzle disperser, L_nd, and a diameter of the nozzle neck with respect to the movement direction of the first refrigerant, d_th, satisfy a relation of $10 \leq L_nd/d_th \leq 50$.

10. The ejector according to claim 6, wherein:

the nozzle body includes a nozzle tip configured to form an outlet of the nozzle disperser; and an outer diameter of the nozzle tip, d_tip, and an inner diameter of the mixer, d_m, form a relation of $d_tip/d_m<1$.

11. The ejector according to claim 10, wherein the outer diameter of the nozzle tip, d_tip, and an inner diameter of the nozzle tip, d_do, form a relation of $1<d_tip/d_do<1.8$.

12. The ejector according to claim 10, wherein a slope between the ejector center axis and an outer surface of the nozzle body forming the nozzle tip, β, is less than or equal to a slope between the ejector center axis and an inner surface of the suction guide unit, ψ.

13. The ejector according to claim 12, wherein the slope (β) satisfies $5° \leq \beta \leq 30°$.

14. The ejector according to claim 12, wherein the slope (ψ) satisfies $20° \leq \psi \leq 60°$.

15. The ejector according to claim 1, wherein:

the diffuser includes a diffuser body extending from the mixer, and a diffuser guide provided on an inner surface of the diffuser body to form a diffuser path through which the mixed fluid formed by the mixer is discharged and formed that a cross-sectional area of the diffuser path is increased in a flow direction of the mixed fluid; and the diffuser guide includes a diffuser curved surface having a curved inner surface.

16. The ejector according to claim 15, wherein the diffuser curved surface is formed of a curved line in which cross-sections with respect to the ejector center axis are symmetrical to each other.

17. The ejector according to claim 15, wherein the diffuser curved surface includes a convex diffuser curved surface formed that a cross-sectional area of the diffuser path is increased and formed to be convex from the diffuser body toward the ejector center axis, and a concave diffuser curved surface arranged at a more downstream side than the convex diffuser curved surface and formed to be concave from the diffuser body from the ejector center axis.

18. The ejector according to claim 17, wherein the diffuser guide further comprises a curved surface connector which has a slope identical to slopes of tangents of an upstream side of the concave diffuser curved surface and a downstream side of the convex diffuser curved surface and connects the convex diffuser curved surface with the concave diffuser curved surface.

19. The ejector according to claim 17, wherein, with respect to the direction of the ejector center axis, an angle between a slope of a diameter of an outlet of the concave diffuser curved surface and a nozzle center axis is greater than 0.

20. The ejector according to claim 10, wherein the diameter of the mixer, d_m, and the outer diameter of the nozzle tip, d_tip, satisfy a relation of $1.2 \leq d_m/d_tip \leq 3$.

21. The ejector according to claim 1, wherein a diameter of the mixer, d_m, and a length of the mixer, L_m, satisfy a relation of $4.5 \leq L_m/d_m \leq 28$.

22. The ejector according to claim 1, wherein a diameter of the mixer, d_m, and a length of the diffuser unit, L_d, satisfy a relation of $7 \leq L_d/d_m \leq 31$.

23. The ejector according to claim 1, wherein a distance between an outlet of the nozzle and an inlet of the mixer, L_n, and a diameter of the mixer, d_m, satisfy a relation of $0.2 \leq L_n/d_m \leq 2.5$.

24. A cooling apparatus, comprising:

a first refrigerant circuit configured so that a refrigerant discharged from a compressor moves to a suction side of the compressor through a condenser, an ejector, and a vapor-liquid separator; and a second refrigerant circuit configured so that the refrigerant is suctioned into a suction port of the ejector and is circulated through the ejector, the vapor-liquid separator, a first expansion device, a first evaporator, and a second evaporator, wherein the ejector includes a nozzle in which a first refrigerant moves, a suction configured to suction a second refrigerant by a flow of the first refrigerant discharged from the nozzle and surround the nozzle unit, a mixer being in communication with the suction and forming a mixed fluid of the first refrigerant and the second refrigerant, and a diffuser configured to convert kinetic energy of the mixed fluid of the first refrigerant and the second refrigerant, discharged from the mixer, into pressure energy, wherein the suction includes a suction port through which the second refrigerant is introduced into an inside of the suction unit, and a tubular suction guide which forms a path in which the second refrigerant moves so that the second refrigerant introduced into the suction port moves along a flow of the first refrigerant and is formed so that a cross-sectional area of the path is reduced in a flow direction of the first refrigerant, and wherein the tubular suction guide includes at least one guide curved surface having a cross-section curved in a fluid movement direction, the at least one guide curved surface includes a concave guide curved surface configured to guide a flow of the second refrigerant so that the second refrigerant moves toward the ejector center axis, and a convex guide curved surface extends from the concave guide curved surface, arranged at a more downstream side than the concave guide curved surface and provided to have a cross-sectional area of the suction path more gently reduced than that of the concave guide curved surface.

* * * * *